US010850410B2

(12) United States Patent
Voorhorst et al.

(10) Patent No.: US 10,850,410 B2
(45) Date of Patent: Dec. 1, 2020

(54) ELECTRICAL APPLIANCE FOR PERFORMING A CUTTING ACTION ON HAIRS AS PRESENT ON AN AREA OF SKIN

(71) Applicant: KONINKLIJKE PHILIPS N.V., Eindhoven (NL)

(72) Inventors: Fokke Roelof Voorhorst, Eindhoven (NL); Gerben Jan Willem Olyerhoek, Eindhoven (NL); Robert Godlieb, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 444 days.

(21) Appl. No.: 15/516,514

(22) PCT Filed: Oct. 7, 2015

(86) PCT No.: PCT/EP2015/073121
§ 371 (c)(1),
(2) Date: Apr. 3, 2017

(87) PCT Pub. No.: WO2016/055509
PCT Pub. Date: Apr. 14, 2016

(65) Prior Publication Data

US 2018/0236674 A1 Aug. 23, 2018

(30) Foreign Application Priority Data

Oct. 7, 2014 (EP) ..... 14188007

(51) Int. Cl.
*B26B 19/38* (2006.01)
*B26B 19/14* (2006.01)

(52) U.S. Cl.
CPC ..... *B26B 19/388* (2013.01); *B26B 19/141* (2013.01); *B26B 19/145* (2013.01)

(58) Field of Classification Search
CPC ..... B26B 19/388; B26B 19/14–18; A45D 26/0028
See application file for complete search history.

(56) References Cited

U.S. PATENT DOCUMENTS 4,168,570 A 9/1979 Bakker
4,719,698 A 1/1988 Ninomiya
(Continued)

FOREIGN PATENT DOCUMENTS

EP 0906814 A1 4/1999
EP 1418027 5/2004
(Continued)

OTHER PUBLICATIONS

JP-04295392—A English translation; Oct. 1992; JP; Tanahashi, Masao.*
(Continued)

*Primary Examiner* — Laura M Lee

(57) ABSTRACT

An electrical appliance for performing a cutting action on hairs present on an area of skin (7) comprises at least one assembly of a driven internal cutting member (5) for cutting off the hairs and an external cutting member (6) which serves for contacting the area of skin (7) and also for covering and contacting the internal cutting member (5). The cutting members (5, 6) are designed such that friction between them is related to their condition of wear in a predetermined way. Information relating to an actual condition of wear of the cutting members (5, 6) is determined by measuring a parameter related to the friction between the cutting members (5, 6) and processing the parameter, and such information is indicated to a user of the appliance.

20 Claims, 3 Drawing Sheets

(56) References Cited

U.S. PATENT DOCUMENTS

| | | | | |
|---|---|---|---|---|
| 5,408,749 | A * | 4/1995 | Momose | B26B 19/141 30/347 |
| 5,600,888 | A * | 2/1997 | Becker | B26B 19/00 30/41.7 |
| 5,983,502 | A * | 11/1999 | Geertsma | B26B 19/14 30/43 |
| 6,354,008 | B1 * | 3/2002 | Domoto | B26B 19/38 30/346.53 |
| 6,460,251 | B1 * | 10/2002 | Orloff | B26B 21/4056 30/34.05 |
| 7,698,819 | B2 | 4/2010 | De Witt | |
| 9,919,437 | B2 * | 3/2018 | Veltman | B26B 19/146 |
| 2009/0000126 | A1 * | 1/2009 | Kraus | B26B 19/046 30/34.1 |
| 2009/0071010 | A1 | 3/2009 | Hart | |
| 2013/0333220 | A1 | 12/2013 | De Wit | |

FOREIGN PATENT DOCUMENTS

| | | | | |
|---|---|---|---|---|
| EP | 1930137 | | 6/2008 | |
| JP | H04105685 | | 4/1992 | |
| JP | 04295392 | A * | 10/1992 | B26B 19/04 |
| JP | 04295392 | A | 10/1992 | |
| JP | H04314486 | | 11/1992 | |
| JP | H07124344 | | 5/1995 | |
| NL | 1004807 | A1 | 7/1997 | |
| WO | 2014032236 | A1 | 3/2014 | |

OTHER PUBLICATIONS

Bhushan, Bharat, "Friction and Wear Measurement Techniques" Modern Tribology Handbook, vol. 1/2, 2001.

* cited by examiner

ELECTRICAL APPLIANCE FOR PERFORMING A CUTTING ACTION ON HAIRS AS PRESENT ON AN AREA OF SKIN

This application is the U.S. National Phase application under 35 U.S.C. § 371 of International Application No. PCT/EP2015/073121, filed on Oct. 7, 2015, which claims the benefit of International Application No. 14188007.0 filed on Oct. 7, 2014. These applications are hereby incorporated by reference herein.

FIELD OF THE INVENTION

The invention relates to an electrical appliance for performing a cutting action on hairs present on an area of skin, comprising a functional head having at least one movably arranged internal cutting member for cutting off the hairs, and further having an external cutting member for contacting the area of skin, wherein the external cutting member is arranged in the functional head to cover and contact the internal cutting member, and wherein the external cutting member is provided with hair-entry apertures for allowing the hairs to penetrate the external cutting member and thereby encounter the internal cutting member; and a motor for driving the internal cutting member of the functional head.

BACKGROUND OF THE INVENTION

In general, in the above-mentioned electrical appliance, it is advantageous for the external cutting member to be as thin as practically possible in order to have optimum cutting results, wherein it is noted that optimum cutting results should be understood such as to be the result of a process during which the hairs are cut off at a position as close as possible to the skin. In a known practical embodiment of the electrical appliance, the external cutting member comprises a thin sheet in which a number of slits are arranged, wherein the slits are intended to serve as the hair-entry apertures of the external cutting member. Portions of the external cutting member delimited by successive slits are referred to as lamellas.

During use of the known electrical appliance, the lamellas are subject to wear and get thinner as a result of contact with the moving internal cutting member. As a consequence, an increase in skin irritation is obtained, and it may even occur that lamellas in the external cutting member break off. In any case, as time passes, the extent of wear of the cutting members can become such that the shaving performance is less than optimal, because the design of the electrical appliance is optimized for the situation of no wear or only minimal wear. Due to the fact that the shaving performance decreases gradually over time, the deterioration of the electrical appliance is not distinctly noticed by a user of the appliance. Only when the user decides to replace the external cutting member, he/she will notice a significant improvement of the shaving performance.

An external cutting member comprising lamellas is commonly used in shavers of the rotary type, i.e. shavers in which the internal cutting member is arranged such as to perform a rotary movement during operation. In another known practical embodiment of the electrical appliance, which is commonly referred to as vibra shaver, the internal cutting member is arranged such as to make an alternating translational movement with respect to the external cutting member. In such a case, the external cutting member generally comprises a metal foil. When it comes to wear, similar problems occur as with shavers of the rotary type. In particular, the foil gets thinner and thinner as a result of use of the vibra shaver, which may eventually lead to breakage of the foil. This is disadvantageous in view of the fact that broken foils may have sharp edges that can hurt the user's skin.

In an electrical appliance in which the thickness of the external cutting member decreases as a result of use of the appliance, a time-based warning system can be used for providing an indication to a user of the appliance that the external cutting member, and possibly also the internal cutting member, should be replaced. However, such a warning system is not accurate as it is not capable of checking an actual condition of wear of the cutting members, as a result of which it may happen that the user is made to replace the external cutting member while it is still in good condition, or, on the other hand, that the external cutting member breaks down before any indication is given to the user.

SUMMARY OF THE INVENTION

It is an object of the invention to provide an electrical appliance which is capable of providing a user of the appliance with information relating to the condition of wear of the cutting members in order to assist the user in determining the right time for replacing the external cutting member, and, if appropriate, also the internal cutting member. In particular, it is an object of the invention to provide an electrical appliance having a wear-indicating functionality which is far more accurate and reliable than the known time-based wear indicating functionality as described in the foregoing.

According to the invention, the object is achieved by providing an electrical appliance for performing a cutting action on hairs present on an area of skin, which appliance comprises a functional head having at least one movably arranged internal cutting member for cutting off the hairs, and further having an external cutting member for contacting the area of skin, wherein the external cutting member is arranged in the functional head to cover and contact the internal cutting member, and wherein the external cutting member is provided with hair-entry apertures for allowing the hairs to penetrate the external cutting member and thereby encounter the internal cutting member; and a motor for driving the internal cutting member of the functional head; wherein the cutting members of the functional head are designed such that friction between said cutting members is related to a condition of wear of the cutting members according to a predetermined relation; and wherein the appliance is equipped with measuring means for performing a measurement of a parameter related to the friction between the cutting members, processing means for processing the measured parameter and thereby determining an actual condition of wear of the cutting members on the basis of the measured parameter, and indicating means for providing a user of the appliance with information relating to the actual condition of wear of the cutting members.

By applying the invention, the wear-indicating functionality of the electrical appliance is improved with respect to the known wear-indicating functionality in that it involves a relation with the actual wear condition. In particular, the invention relies on measuring a parameter related to the friction between the cutting members. Furthermore, the cutting members are designed such that the friction between them is related to their condition of wear in a predetermined way, i.e. according to a predetermined relation. Hence, in general, the invention is based on the insights that it is a practical possibility to use friction between the cutting members as a measure of the actual wear of the cutting members and that it is possible to design the cutting members in such a way that a predetermined relation between wear and friction is realized. Due to the specific design of the cutting members as mentioned and measurements of the friction-related parameter as mentioned, a reliable indication of the actual condition of wear, which is reproducible for various sets of cutting members of the same type, is achieved.

In a preferred embodiment of the electrical appliance according to the invention, according to the predetermined relation, the parameter has a predetermined property when the condition of wear is at a predetermined level corresponding to a required replacement of the cutting members, and wherein the indicating means indicate the required replacement of the cutting members when the measured parameter has the predetermined property. The predetermined property of the parameter may be a predetermined value of the parameter which significantly differs from a value of the parameter corresponding to an initial condition of the cutting members wherein the cutting members do not yet show any substantial degree of wear. Alternatively, the predetermined property of the parameter may be a predetermined change of the value of the parameter during a predetermined time interval. In this embodiment, the indicating means indicate the required replacement of the cutting members in a reliable manner, i.e. at a predetermined level of wear of the cutting members at which proper functioning of the cutting members may no longer be achieved.

In a practical embodiment, the cutting members may be designed such that the friction between them is at a first level during a first period of operation following initial use and an initial running-in period of the cutting members, and changes significantly during a second period of operation following the first period of operation, and is at a second level, which is significantly different from the first level, during a third period of operation following the second period of operation. In such an embodiment, due to the distinct levels of friction, it is possible to determine the period of operation at any given time. Assuming that the cutting members are designed such that the first period of operation is associated with safe use of the cutting members, and the second period of operation is associated with a transition from safe use to a need of replacement, and the third period of operation is associated with the need of replacement, the condition of wear is found by measuring the friction-related parameter and processing the parameter in such a way that the period of operation and, consequently, the indication of the condition of wear is determined.

Within the scope of the invention, it is possible for the cutting members to not only be designed such that there is friction between them which is at one of two levels or in a transition between the levels, but also such that there is a third level preceded by a transition between the second level and the third level as use of the appliance continues over time. In other words, it is possible for the cutting members to furthermore be designed such that the friction changes significantly during a fourth period of operation following the third period of operation, and is at a third level which is significantly different from both the first level and the second level during a fifth period of operation following the fourth period of operation. When a third level of friction can be realized, it is possible to use the third period of operation as a basis for a non-urgent indication of a need of replacement of the cutting members, while the fifth period of operation can be used as a basis for an urgent indication of the need of replacement, for example.

According to a feasible option existing within the scope of the invention, a parameter, related to operation of the motor, prevailing during idle running of the functional head, i.e. during operation of the appliance but before the appliance is actually placed in a position for performing a hair cutting action, can be used as the friction-related parameter. This option is based on the insight that a predetermined relation exists between friction between the cutting members during idle running and the power needed for driving the cutting members, wherein it is true that the power is higher when the friction is higher. It is very well possible to measure a parameter related to operation of the motor, which may be the value of the current which is supplied to the motor, for example, as there is a relation between the current and the torque of the motor, and a relation between the torque and the friction. This option is even more advantageous in view of the fact that it is known for electrical shavers and the like to be equipped with a system for monitoring the current in order to be able to detect a situation in which the current rises to a much higher level than normal due to jamming of the internal cutting member or other problems. It now appears to be possible to use existing measuring means for putting the invention into practice, so that only minimal changes in the design of existing electrical appliances are needed.

When the parameter related to operation of the motor is measured, it is a practical possibility for the processing means to be adapted to determine a difference between a value of an actual measurement of the parameter and at least one reference value of the parameter, and to determine the information to be indicated to the user on the basis of the difference. For example, one reference value which represents a condition of no wear or acceptable wear can be used, wherein the user is informed that the condition of wear is such that safe-use conditions exist when the actual value of the parameter is within a predetermined range including the reference value, and that the condition of wear is such that replacement of the cutting members is needed when the actual value is outside of the range.

The at least one reference value can be preprogrammed in the processing means, or the processing means can be adapted to retrieve information regarding the reference value from the Internet or other communication means. According to another possibility, the processing means are adapted to determine an end of an initial running-in period after the appliance has been activated for the very first time, and to determine the at least one reference value of the parameter on the basis of a value of a measurement performed at the end of the running-in period. The assumption underlying this is that as soon as the running-in period has ended, the cutting members are in an actual starting condition which is as close as possible to theoretical specifications. In this way, it is ensured that the reference value is representative of a situation in which there is practically no wear of the cutting members, which, after initial use of the appliance, is a situation in which the cutting members have just been replaced and are in the starting condition after the running-in period. For the sake of completeness, it is noted that the end of the running-in period may be determined by monitoring the values of the parameter and finding a minimum or a maximum value, whatever is appropriate, of the parameter after the very first use of a set of cutting members.

As noted in the foregoing, according to the invention, the cutting members are designed such that friction between them is related to their condition of wear in a predetermined way. For example, it may be that the cutting members are designed such that they cause a change of at least one of: the types of material in a contact area between them, and the size and/or position of the contact area between them at a predetermined degree of wear. When one type of material in a contact area between the cutting members has worn away and another type of material is exposed and/or contacted as a result thereof, a change of friction between the cutting members may occur, which is very well detectable when the level of friction between the cutting members associated with the initial material is significantly different from the level of friction between the cutting members associated with the final material. Therefore, an appropriate choice of materials, such as a rubber-like material for a high coefficient of friction and coatings for a low coefficient of friction, enables an indication of a condition of wear of the cutting members to be obtained, especially when the initial material is chosen such as to be worn away at the end of the period of safe use of the cutting members. Additionally or alternatively, it is possible to design the cutting members in such a way that, when a certain condition of wear is achieved, the size and/or the position of the contact area between them changes. The change may be gradual or rather abrupt. In general, when the size of the contact area between the cutting members increases, the level of friction increases. When the position of the contact area between the cutting members changes, the torque level related to friction changes too, based on the assumption of rotary movement of the inner cutting member. For example, when the contact area is ring-shaped and the radius of the contact area decreases, the friction torque decreases as well. Similar to the change of the type of material, the change of the size and/or position of the contact area can be brought about by providing at least one of the cutting members with a portion that will wear away over time, which does not alter the fact that other options exist as well within the scope of the invention.

Next, practical examples of the change of a) types of material in the contact area between the cutting members and/or b) the size and/or position of the contact area are given:

1) in case the appliance is of the rotary type, one of the cutting members comprises a pin which is arranged on a side of the relevant cutting member facing the other cutting member and which extends in a direction towards the other cutting member, wherein a length of the pin corresponds to a distance which is present between the cutting members at the position of the pin in a condition of wear which is predetermined to be a worn-away condition of the cutting members;

2) in case the appliance is of the rotary type, one of the cutting members comprises a pin which is arranged on a side of the relevant cutting member facing the other cutting member and which extends in a direction towards the other cutting member, wherein a length of the pin corresponds to a distance which is present between the cutting members at the position of the pin in a condition of wear which is predetermined to be a worn-away condition of the cutting members, and wherein at least an area of the pin for contacting one of the cutting members in the worn-away condition of the cutting members comprises material for causing a change of friction between the cutting members during operation when the area of the pin comes into contact with said other cutting member;

3) both cutting members comprise at least one bump/rib which is arranged on a side of the relevant cutting member facing the other cutting member, wherein the bumps/ribs of the cutting members are arranged for contacting each other when a predetermined degree of wear of the cutting members is reached and hence the cutting members have moved closer towards one another;

4) one of the cutting members comprises a layered structure of at least two different materials in an area for contacting the other one of the cutting members;

5) a surface of one of the cutting members facing the other one of the cutting members comprises an elevated surface portion which is intended to wear away as a result of contact with the other one of the cutting members; and 6) a surface of one of the cutting members facing the other one of the cutting members is provided with at least one projection, and wherein a surface of the other one of the cutting members is provided with at least one recessed portion at a similar position.

In the first and the second example, the indication of the condition of wear of the cutting members is obtained on the basis of a design of the cutting members in which the distance between the cutting members at the position of the pin is initially large enough for the pin of one cutting member not to contact the other cutting member, and in which the distance decreases due to wear. The pin may be shaped like a solid cylinder having a circular end surface, but it is also practical for the pin to be shaped like a hollow cylinder having a ring-shaped end surface. Furthermore, the pin may be centrally positioned on one of the cutting members, wherein a longitudinal axis of the pin coincides with an axis of rotation of the internal cutting member, or the pin may be eccentrically positioned on said one of the cutting members, wherein the longitudinal axis of the pin may extend substantially parallel to the axis of rotation of the internal cutting member. In any case, the length of the pin is chosen such that, as soon as a predetermined condition of wear of the cutting members has been attained, the pin comes into contact with the other one of the cutting members, which mainly involves a friction torque change, wherein the friction torque change may be a decrease or an increase, depending on the positioning of the pin with respect to the initial contact area. The effect of the creation of the additional contact area between the cutting members at a certain point, namely when the pin of one cutting member contacts the other cutting member, can be enhanced by providing an area of the pin for contacting the other cutting member with a material for bringing about another level of friction between the cutting members when said additional contact through the pin is established.

In the third example, the indication of the condition of wear of the cutting members is obtained on the basis of a design of the cutting members in which both cutting members comprise at least one bump/rib, wherein the bumps/ribs of the cutting members are arranged for contacting each other. The use of the bumps/ribs involves a change in the shape of the signal representing the friction-related parameter during one rotation for a rotary system or one stroke for a linear system. For example, when one set of bumps/ribs is used, a more or less constant level of friction is measured plus one instance of the bumps/ribs hitting against each other when a predetermined level of wear has been reached and the bumps/ribs are in contact. Hence, a signal containing a repetition of peaks is obtained, which is very suitable to be used for detection purposes as the occurrence of the peaks is not susceptible to external influences such as the degree of lubrication between the cutting members. When at least two bumps/ribs are used on one of the cutting members, it is possible to design the cutting members such that a change of the number and/or pattern of the bumps/ribs which come into contact is realized at a predetermined condition of wear of the cutting members. Such a change is detectable as it leads to a change in the shape of the signal during one rotation or stroke. More than two bumps/ribs on one of the cutting members may be used as signal markers, allowing for pre-programming of detected levels of wear. For example, one signal marker may be representative of wear of at least 10 microns, whereas another pattern of signal markers may be representative of wear of at least 25 microns.

In the fourth example, the indication of the condition of wear of the cutting members is obtained on the basis of a design of the cutting members in which two different materials are used in one of the cutting members, wherein friction associated with contact through a first of the materials is different from friction associated with contact through a second of the materials, and wherein the first of the materials is worn away at a predetermined level of wear of the cutting members.

In the fifth example, the indication of the condition of wear of the cutting members is obtained on the basis of a design of the cutting members in which a change of the size and/or position of the contact area between the cutting members is obtained as soon as an elevated surface portion of one of the cutting members has worn away.

In the sixth example, the indication of the condition of wear of the cutting members is obtained on the basis of a design of the cutting members in which use is made of a projection which needs to pass through a recessed portion during operation, and on the basis of the fact that the extent to which the projection projects into the recessed portion determines the friction force to be overcome in the process. In general, the friction force is higher when the projection projects further into the recessed portion, which is a situation which may occur when the cutting members come closer together due to wear.

When the invention is applied, it is achieved that the actual condition of wear of the functional head of an electrical appliance as defined in the foregoing can be communicated to a user of the appliance. According to the invention, the wear-indicating functionality involves measuring a parameter related to the friction between the cutting members which are part of the functional head, wherein the cutting members are designed such that the friction between them is related to their condition of wear in a predetermined way. When the parameter is found to be outside a predetermined range associated with acceptable wear and safe use, it is communicated to the user that it is time to replace the cutting members. As the indication is based on measurements, it is not necessary to have a manual reset when replacement of the cutting members has taken place and new cutting members have been installed.

The indication to the user may be realized in any possible manner. For example, the indicating means may be adapted to emit a sound signal or a light signal during the time that a worn-away condition of the cutting members is found to exist. Also, it is possible to have a display or the like for showing information in a more sophisticated manner, such as through symbols or text messages. On the other hand, a change of friction can lead to a change of sound emitted as a result of the contact between the cutting members. Especially for low-end products, sound can be used to provide a user with an indication of the condition of wear of the cutting members.

The above-described and other aspects of the invention will be apparent from and elucidated with reference to the following detailed description of a number of possible designs of cutting members to be used in a shaving appliance of the rotary type which is adapted to determine and indicate a condition of wear of the cutting members to a user of the appliance. The fact that the invention will be explained in the context of a shaving appliance of the rotary type should not be understood such as to imply that the invention cannot be used in other contexts, such as the context of a shaving appliance in which the internal cutting member is arranged for performing a reciprocating linear movement, the context of a trimming appliance, or the context of a grooming appliance.

BRIEF DESCRIPTION OF THE DRAWINGS

The invention will now be explained in greater detail with reference to the figures, in which equal or similar parts are indicated by the same reference signs, and in which.

These figures are only intended to provide a diagrammatic representation of aspects of the invention. In particular, the various components shown in the figures are not drawn to scale.

DETAILED DESCRIPTION OF EMBODIMENTS

Figure 1:
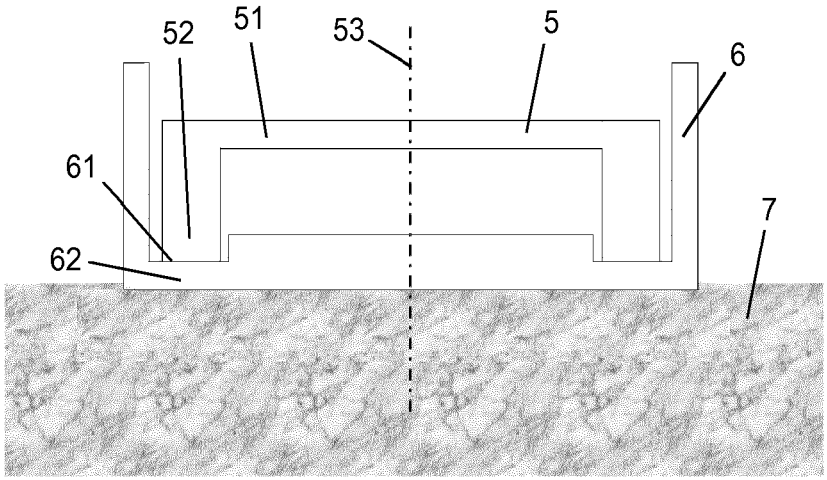
FIG. 1 diagrammatically shows a sectional view of a known configuration of a rotatably arranged internal cutting member, an external cutting member and a portion of skin.
Figure 10:
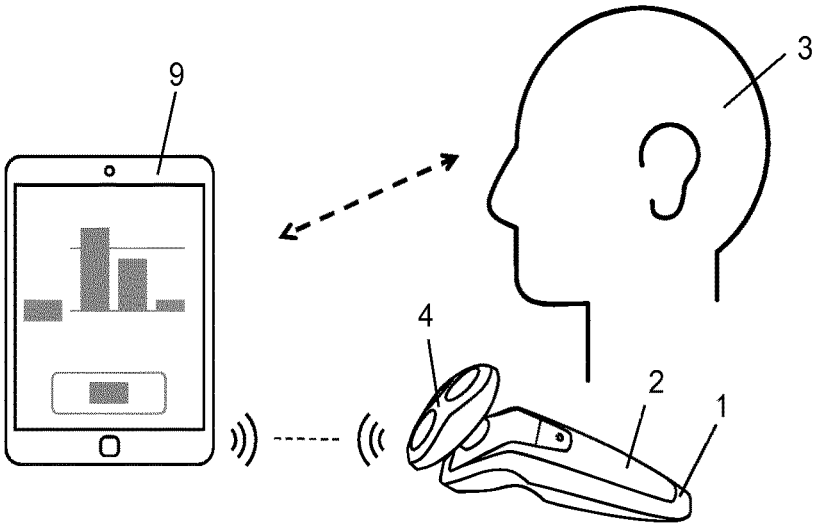
FIG. 10 illustrates how a device in communication with a shaving appliance can be used for indicating a condition of wear of the cutting members of the functional head of the appliance to a user of the appliance.

As mentioned in the foregoing, examples of the invention, as will be discussed in the following, are in the context of a shaving appliance of the rotary type. With reference to FIG. 10, it is noted that, in general, such a shaving appliance 1 is a hand-held appliance comprising a handle 2, which is intended to be taken hold of by a user 3, and a functional head 4 which is intended to be placed against the user's skin to be subjected to a shaving action. With reference to FIG. 1, it is furthermore noted that, in general, the functional head 4 comprises at least one assembly of an internal cutting member 5 and an external cutting member 6. The internal cutting member 5 is rotatably arranged and comprises a disc-shaped base 51 having a circular periphery and legs 52 extending from the periphery of the base 51 towards the external cutting member 6, the legs 52 having cutters at their free ends for cutting through the hairs to be removed from the skin 7. In the diagrammatic sectional view of FIG. 1, only two legs 52 are shown. It is known for the legs 52 to be distributed along the periphery of the base 51 and to be provided in a number which is considerably larger than two, e.g. twelve. In FIG. 1, an axis of rotation of the internal cutting member 5 is depicted as a dash-dot line and indicated by reference numeral 53. The external cutting member 6 is arranged such as to cover the internal cutting member 5, thereby preventing the internal cutting member 5 from contacting the skin 7, and comprises hair-entry apertures (not shown in FIG. 1) for allowing the hairs to penetrate the external cutting member 6 and hence encounter the internal cutting member 5. The shaving appliance 1 comprises a motor (not shown in any of the figures) for driving the internal cutting member 5 during operation of the appliance 1.

In the shown examples, the external cutting member 6 is in contact with the internal cutting member 5 in a ring-shaped or torus-shaped area, which will hereinafter be referred to as shaving area 61, wherein contact between the cutting members 5, 6 is maintained under the influence of a force acting on the internal cutting member 5 in the direction of the external cutting member 6. Generally, the hair-entry apertures are present in the shaving area 61 and comprise a plurality of slits, dividing the shaving area 61 into lamellas 62. For the sake of completeness, it is noted that the slits may be radially oriented, but that other orientations are also possible. Also, besides the slits, more or less circular holes may be present in the external cutting member 6. Furthermore, it is noted that the thickness of the lamellas 62 is exaggerated in FIG. 1. In reality, the lamellas 62 are made to very accurate thickness dimensions in order to control a balance between skin irritation and shaving results. A practical thickness of the lamellas 62 is 80 microns with an accuracy of +/−5 or 6 microns. Wear of the lamellas 62 taking place over time under the influence of contact with the rotating internal cutting member 5 may cause the thickness of the lamellas 62 to be reduced to 70 microns. When the thickness is reduced even further, to 60 microns or 50 microns, skin irritation will increase. However, this is usually not taken as a signal that at least the external cutting member 6 should be replaced by the user 3 of the shaving appliance 1, due to the gradual nature of the increase. This is a risk in the use of the appliance 1, because the shaving performance and the balance between skin irritation and smoothness of the shaving results can be restored only by timely replacing the external cutting member 6, and, in addition, the risk of breakage of the external cutting member 6 will be reduced to a minimum again.

The invention provides a way of indicating to a user 3 an appropriate moment for replacing the cutting members 5, 6. In the following, various embodiments of the invention will be explained on the basis of FIGS. 2-10.

Figure 2:
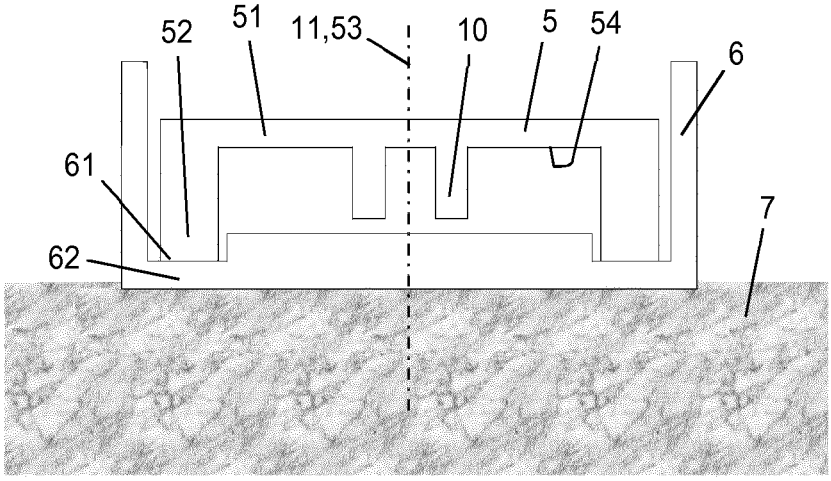
FIGS. 2 and 3 diagrammatically show a sectional view of a first embodiment according to the invention of a rotatably arranged internal cutting member, an external cutting member and a portion of skin, in two different conditions of wear of the cutting members.
Figure 3:
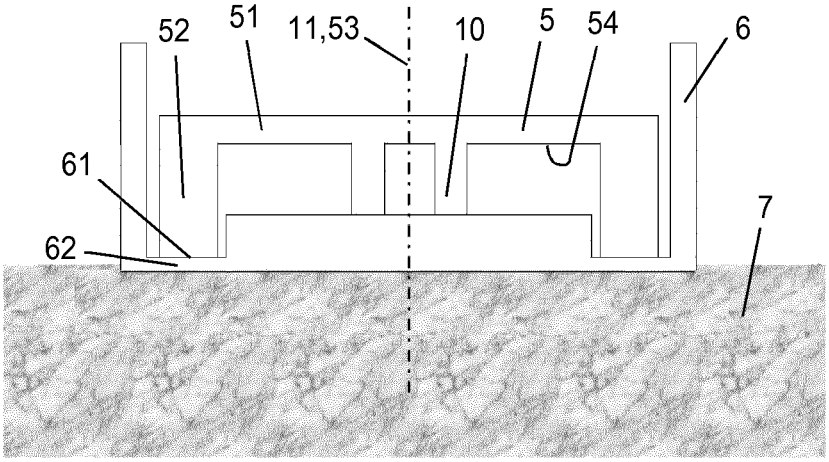

In FIGS. 2 and 3, it is shown how the internal cutting member 5 can be equipped with a centrally arranged pin 10 on the side 54 of the internal cutting member 5 facing the external cutting member 6. In particular, in the shown example, the pin 10 has a central position in which a longitudinal axis 11 of the pin 10 coincides with the axis of rotation 53 of the internal cutting member 5. Furthermore, in the shown example, the pin 10 is shaped like a hollow cylinder having a ring-shaped end surface, wherein the radius of the pin 10 is smaller than the radius of the shaving area 61 of the external cutting member 6.

In FIG. 2, an initial situation is illustrated, i.e. a situation in which the external cutting member 6 is free from wear. The length of the pin 10 is such that, in this situation, contact between the internal cutting member 5 and the external cutting member 6 occurs at the shaving area 61 of the external cutting member 6 only. In other words, the length of the pin 10 is shorter than the distance between the cutting members 5, 6 at the position of the pin 10 in the initial situation. FIG. 3 depicts a situation in which the thickness of the shaving area 61 has decreased with respect to the initial thickness due to wear, and in which contact between the internal cutting member 5 and the external cutting member 6 takes place at the shaving area 61 of the external cutting member 6 as well as at the end surface of the pin 10. In this situation, in view of the fact that the ring-shaped end surface of the pin 10 is considerably larger than the total of the surfaces of the cutters at the end of the legs 52 of the internal cutting member 5, most of the friction forces prevailing between the cutting members 5, 6 cover a considerably smaller diameter than in the initial situation, as a consequence of which the torque needed for the friction forces is considerably smaller.

By applying the pin 10, it is possible to find the exact moment in time when the condition of wear of the cutting members 5, 6 is such that replacement is appropriate. This can be attributed to the fact that the length of the pin 10 can be chosen such that it is ensured that the pin 10 comes into contact with the external cutting member 6 when the thickness of the lamellas 62 has decreased to a predetermined extent. For example, if it is advisable to replace the external cutting member 6 when the thickness of the lamellas 62 has decreased by 15 microns, the length of the pin 10 is chosen such as to equal the distance between the cutting members 5, 6 at the position of the pin 10 in the initial situation minus 15 microns and the associated wear of the internal cutting member 5, which may exceed 15 microns in practical cases.

On the basis of the fact that motor power is directly related to the torque provided by the motor, it is a practical possibility to measure the power which is consumed by the motor for operating the appliance 1 when it has just been switched on but not yet been placed against the user's skin 7, and to compare the actual value as found to a reference value associated with a situation of acceptable wear in order to determine whether the pin 10 is in contact with the external cutting member or not. As soon as it is found that the actual value differs too much from the reference value, for example, by 30% or 40%, it is safe to assume that the large difference is caused by contact of the pin 10, so that a reliable indication can be given to the user 3 that it is time to replace the external cutting member 6, and possibly also the internal cutting member 5.

The reference value of the motor power can be determined in any possible way. For example, it is an option to log the initial motor power over time and conclude that the pin 10 is in contact with the external cutting member 6 when the power changes to a considerable extent.

It is noted that it is alternatively possible to measure the motor power during a shaving action in order to assess the condition of wear of the cutting members 5, 6. However, in such a case, power is not only needed to overcome friction, but also to perform a cutting process. As a consequence, it is hard to distinguish the friction power from the cutting power. That is the reason why it is preferred to perform the measurement of the motor power for the purpose of determining the condition of wear of the cutting members 5, 6 before a shaving action is actually started, i.e. the time which is available between the moment that the user 3 switches on the appliance 1 and places the functional head 4 against the skin 7 to be subjected to the shaving action.

Figure 4:
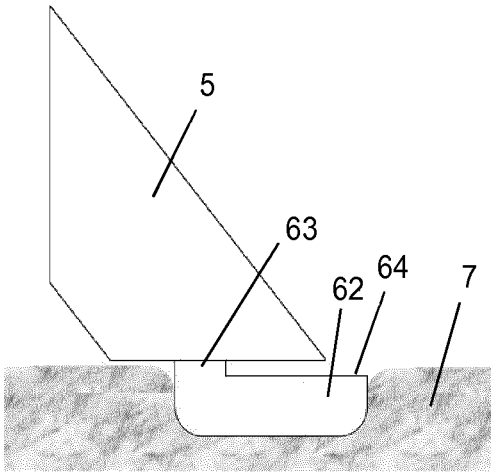
FIGS. 4 and 5 diagrammatically show a sectional view of a second embodiment according to the invention of a rotatably arranged internal cutting member, an external cutting member and a portion of skin, in two different conditions of wear of the cutting members, wherein it is noted that only a relevant portion of the cutting members is shown.
Figure 5:
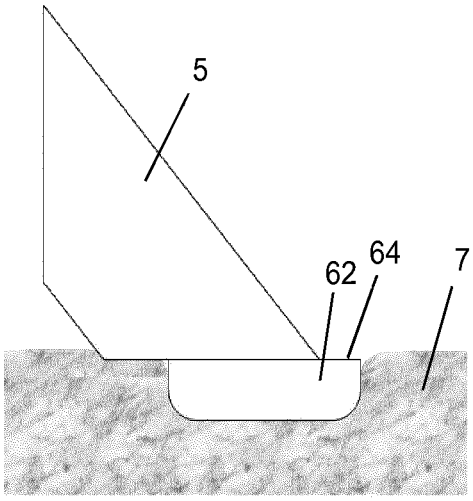

In FIGS. 4 and 5, another option for obtaining a reliable indication of the condition of wear of the cutting members 5, 6 is illustrated. According to this option, which is applicable to both rotary systems and linear systems, the lamellas 62 of the external cutting member 6 comprise an elevated surface portion 63 on the side 64 facing the internal cutting member 5. In general, in the friction regime of shaving, friction is proportional to the contact area between the cutting members 5, 6 due to a viscous component of the friction forces. In particular, skin grease between the internal cutting member 5 and the lamellas 62 of the external cutting member 6 shears when the internal cutting member 5 moves with respect to the external cutting member 6, and it is this shearing of grease which leads to shear forces which are proportional to the shearing/contact area. Hence, it is possible to have different outcomes of measurements of the motor power or another suitable parameter and to link those outcomes to different dimensions of contact surfaces.

In particular, in the shown example, initial contact between the cutting members 5, 6 is established through the elevated surface portion 63 of the lamellas 62 of the external cutting member 6. With use and time, the elevated surface portion 63 of the appliance 1 gets worn away. As a result, at a certain point in time, there is a change of the nature of the contact between the cutting members 5, 6, wherein the contact changes from contact through the elevated surface portion 63 of the lamellas 62, which has relatively small dimensions with respect to the total dimensions of the lamellas 62, to contact through a major portion of the lamellas 62. This change can be detected because it involves an increase of friction forces and a related increase of motor power needed during idle running. By choosing an appropriate height of the elevated surface portion 63 of the lamellas 62, the change of the motor power can be relied upon for obtaining an indication that the cutting members 5, 6 are in a worn-away condition. It will be clear to a person skilled in the art that it is equally well possible to apply elevated surface portions on the internal cutting member 5 for obtaining the above-described change of the dimensions of the contact area between the cutting members 5, 6 at a predetermined degree of wear of the cutting members 5, 6.

Figure 6:
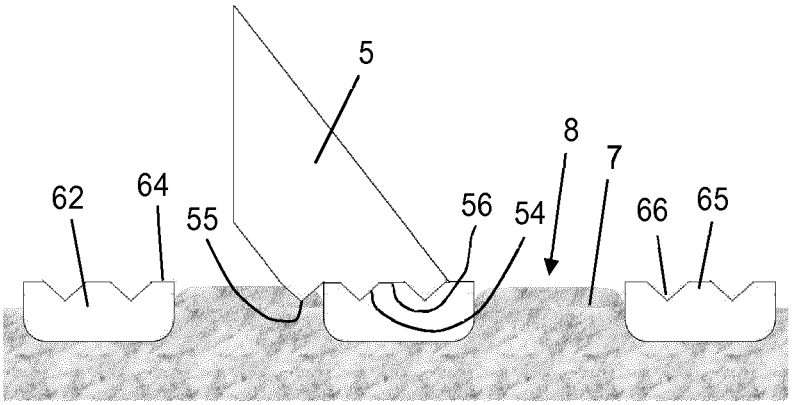
FIG. 6 diagrammatically shows a sectional view of a third embodiment according to the invention of a rotatably arranged internal cutting member, an external cutting member and a portion of skin, wherein it is noted that only a relevant portion of the cutting members is shown.

FIG. 6 illustrates how the sides 54, 64 of the cutting members 5, 6 facing each other can be provided with a special shape in order to obtain a reliable indication of the condition of wear of the cutting members 5, 6. In the shown example, which is applicable to both rotary systems and linear systems, the sides 54, 64 of said cutting members 5, 6 are not flat, but comprise a pattern of projections 55, 65 and recesses 56, 66. When the cutting members 5, 6 move closer towards each other due to wear, the force needed to move the internal cutting member 5 with respect to the external cutting member 6 increases, as during the movement increasingly higher obstacles are encountered at the positions of the transitions of the recesses 56, 66 to the projections 55, 65, each time a cutter of the internal cutting member 5 moves over a lamella 62 of the external cutting member 6. For the sake of completeness, it is noted that in FIG. 6 a number of lamellas 62 is shown, wherein the hair-entry apertures which are present between the lamellas 62 are indicated by reference numeral 8.

As explained in the foregoing, a time-varying level of force needed to move the internal cutting member 5 can be used in a process of determining the condition of wear of the cutting members 5, 6. In the case illustrated in FIG. 6, a considerable increase of the force is directly related to a worn-away condition of the cutting members 5, 6. Furthermore, as explained in the following, measuring a motor power parameter, such as the torque, every time that the appliance 1 is switched on is a practical option for monitoring the variation of the force level.

Figure 7:
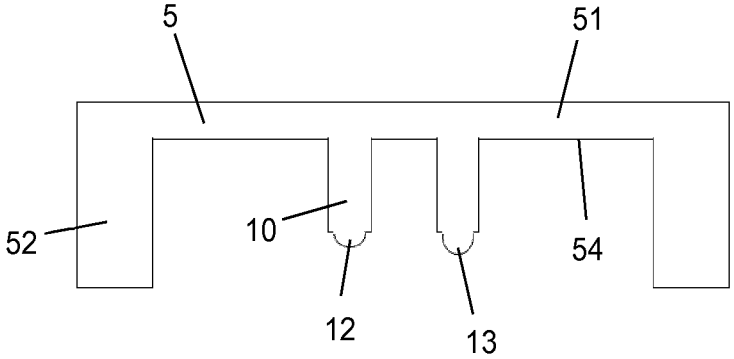
FIG. 7 diagrammatically shows a sectional view of a fourth embodiment according to the invention of a rotatably arranged internal cutting member.

FIG. 7 illustrates how it is possible to obtain an extremely reliable indication of different levels of wear when a pin 10 is used, such as shown in FIGS. 2 and 3. As explained in the foregoing, it is possible to use the pin 10 for indicating a condition of wear, based on the fact that as soon as the pin 10 contacts the external cutting member 6, the radius of contact between the cutting members 5, 6 decreases, which causes a reduction of the friction torque. By choosing an appropriate length of the pin 10, the moment of the reduction of the friction torque can be made to correspond to the moment that the condition of wear of the cutting members 5, 6 can be denoted as being a worn-away condition.

According to the option illustrated in FIG. 7, two bumps 12, 13 are disposed at the ring-shaped end surface of the pin 10, in a diametrical positioning, wherein one bump 13 is higher than the other bump 12. The external cutting member 6 is also provided with at least one bump or rib on the side 64 facing the internal cutting member 5. (This is not illustrated in FIG. 7.) The use of the highest bump 13 on the pin 10 and, at a later stage, the lowest bump 12, involves a change in the shape of the signal representing the friction-related parameter during one rotation of the internal cutting member 5. For example, the highest bump 13 can be made so as to come into contact with the bump/rib of the external cutting member 6 after a first amount of wear of 15 microns. In that case, every rotation involves a peak in the signal. Eventually, as a result of continued operation of the appliance 1 over time, the highest bump 13 wears down and the cutting members 5, 6 move closer. At a certain point, after a second amount of wear, which may also be 15 microns, for example, the height of the highest bump 13 is reduced to such an extent that it resembles the height of the lowest bump 12, so that both bumps 12, 13 contact the bump/rib of the external cutting member 6 during one rotation, which results in a signal having two peaks per rotation. The bumps 12, 13 may be made from plastic, for example, in order to have bumps 12, 13 which are subject to wear in an appropriate way.

The capability of distinguishing various predetermined levels of wear of the cutting members 5, 6 makes it possible to provide more detailed information to the user 3, disclosing the gradual change in the shaving appliance 1. In such a case, it may be desirable to use devices or services connected to the shaving appliance 1 for communicating the information to the user 3, as illustrated in FIG. 10. For example, the shaving appliance 1 with the wear-indicating functionality may be adapted to transmit information regarding the condition of wear of the cutting members 5, 6 to a mobile phone 9 through Bluetooth. That does not alter the fact that the hand-held appliance 1 may comprise a display or other suitable means for indicating a condition of wear. In any case, the shaving appliance 1 may be equipped with an internal or external controller (not shown) for controlling the process of measuring the motor power parameter at the appropriate time and determining the type of information to be indicated to the user 3 regarding the condition of wear of the cutting members 5, 6. In general, in case one or more external components are used with the shaving appliance 1, for example, components which serve as processing means and/or indicating means, the total arrangement comprising both the shaving appliance 1 and the relevant components is to be understood to make up the electrical appliance as defined in the claims.

Figure 8:
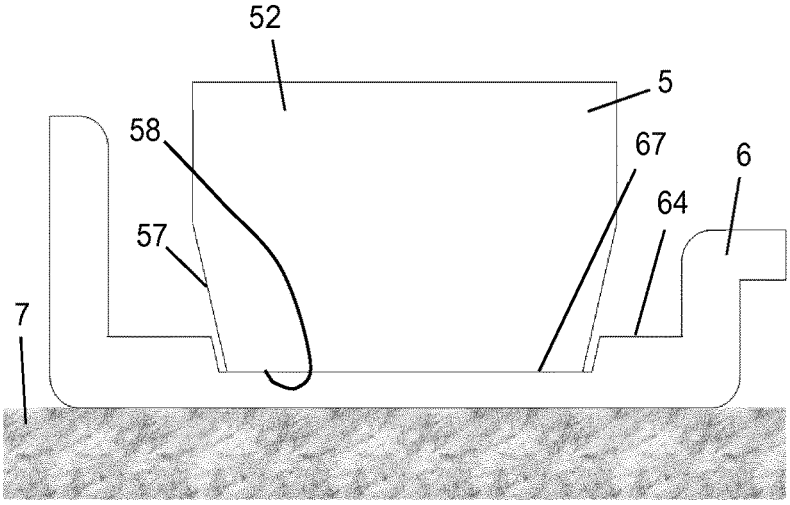
FIGS. 8 and 9 diagrammatically show a sectional view of a fifth embodiment according to the invention of a rotatably arranged internal cutting member, an external cutting member and a portion of skin, in two different conditions of wear of the cutting members, wherein it is noted that only a relevant portion of the cutting members is shown.
Figure 9:
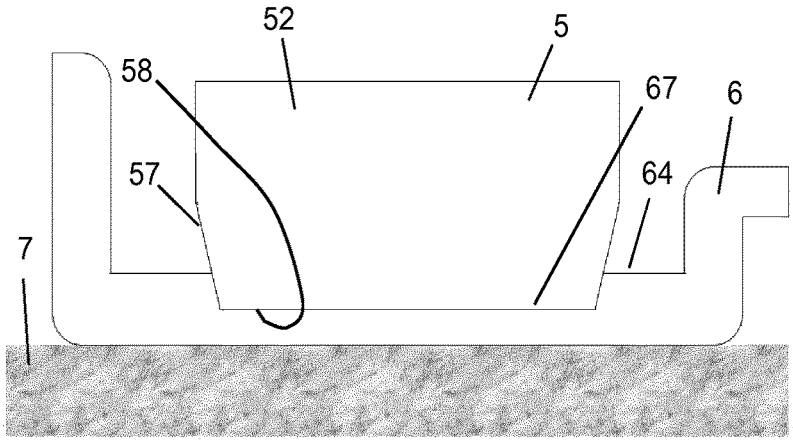

FIGS. 8 and 9 illustrate an option comprising at least one groove 67 in the side 64 of the external cutting member 6 facing the internal cutting member 5, said groove(s) extending in the direction of movement of the internal cutting member 5. Therefore, in a rotary system, the groove 67 has a generally ring-shaped appearance. In the sectional views of FIGS. 8 and 9, only one sectional half of the external cutting member 6 and a free end of one leg 52 of the internal cutting member 5 are shown. The basic concept applied in this embodiment is that a pin or rib has more friction when moving through a V-shaped groove than when moving on a flat surface. The outmost portion of the free end of the leg 52 is beveled, such that the portion has angled sides 57. In the initial situation, as shown in FIG. 8, the contact between the cutting members 5, 6 is only through a bottom 58 of the outmost portion of the leg 52 of the internal cutting member 5. After wear, contact is also through the angled sides 57, as shown in FIG. 9. In that situation, vertical forces acting on the internal cutting member 5 are partly transmitted through the angled sides 57. This leads to a high normal force on the sides 57, invoking high friction forces in the direction of movement perpendicular to the external cutting member 6. Hence, in the situation after wear, the friction is higher than in the initial situation. The increase in friction depends on the angle of the angled sides 57. By measuring a friction-related parameter, such as a motor power parameter, and determining whether the parameter has increased to such an extent that a worn-away condition of the cutting members 5, 6 has been reached, a useful indication of the condition of wear can be given to the user 3.

It is possible to have more than one groove 67 in the external cutting member 6 and more than one portion having angled sides 57 at a corresponding position on the internal cutting member 5. In known embodiments of a rotary shaver, the shaving area 61 mentioned hereinbefore is present in the external cutting member 6, which almost has a suitable shape for acting as the groove 67 described in the foregoing. Thus, in such embodiments, it is preferred to have only one groove 67 in order to minimize adaptations to the design of the external cutting member 6.

It will be clear to a person skilled in the art that the scope of the invention is not limited to the examples discussed in the foregoing, but that several amendments and modifications thereof are possible without deviating from the scope of the invention as defined in the attached claims. While the invention has been illustrated and described in detail in the figures and the description, such illustration and description are to be considered illustrative or exemplary only, and not restrictive. The invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the invention.

In addition to the embodiments of the invention shown in the figures, or as an alternative, a concept comprising multiple layers of material of at least one of the cutting members 5, 6 at the contact position between the cutting members 5, 6, wherein a top layer may be worn away over time so that an underlying layer is exposed, and wherein a change of friction is obtained on the basis of a change of material, can be applied to arrive at a useful indication of the condition of wear of the cutting members 5, 6.

In short, the invention relates to an electrical appliance 1 for performing a cutting action on hairs present on an area of skin 7, comprising at least one assembly of a driven internal cutting member 5 for cutting off the hairs and an external cutting member 6 for contacting the area of skin 7 and also for covering and contacting the internal cutting member 5. The cutting members 5, 6 are designed such that friction between them is related to their condition of wear in a predetermined way. Information relating to an actual condition of wear of the cutting members 5, 6 is determined by measuring a parameter related to the friction between the cutting members 5, 6 and processing the parameter, and such information is indicated to a user 3 of the appliance 1.

The invention claimed is:

1. An electrical appliance for performing a cutting action on hairs present on an area of skin, the electrical appliance comprising:

a functional head having at least one movably arranged internal cutting member for cutting off the hairs, and further having an external cutting member for contacting the area of skin, wherein the external cutting member is arranged in the functional head to cover and contact the internal cutting member, wherein the external cutting member is provided with hair-entry apertures for allowing the hairs to penetrate the external cutting member and thereby encounter the internal cutting member, and wherein the internal cutting member and the external cutting member are designed such that a friction between the internal cutting member and the external cutting member is related to a condition of wear of at least one of the internal cutting member and the external cutting member according to a predetermined relation between the friction and the wear;

a motor for driving the internal cutting member of the functional head;

measuring means for performing a measurement of a parameter related to the friction between the internal cutting member and the external cutting member;

processing means for processing the measured parameter and thereby determining an actual condition of wear of one of the internal cutting member and the external cutting member on the basis of the measured parameter; and indicating means for providing a user, of the electrical appliance with information relating to the actual condition of wear of the one of the internal cutting member and the external cutting member; wherein the internal cutting member is rotatably arranged in the functional head, wherein the internal cutting member includes a pin which is arranged on a side of the internal cutting member facing the external cutting member and which extends in a direction towards the external cutting member, and wherein a length of the pin corresponds to a distance which, when present between the internal cutting member and the external cutting member, is predetermined to be a worn-away condition of at least one of the internal cutting member and the external cutting member.

2. The electrical appliance according to claim 1, wherein, according to the predetermined relation, the parameter has a predetermined property when the condition of wear is at a predetermined level corresponding to a required replacement of at least one of the internal cutting member and the external cutting member; and wherein the indicating means indicate the required replacement of the at least one of the internal cutting member and the external cutting member when the measured parameter has the predetermined property.

3. The electrical appliance according to claim 1, wherein the internal cutting member and the external cutting member are designed such that the friction between them is at a first level during a first period of operation following initial use and an initial running-in period of the internal cutting member and the external cutting member, the friction changes during a second period of operation following the first period of operation, and the friction is at a second level, which is different from the first level, during a third period of operation following the second period of operation.

4. The electrical appliance according to claim 3, wherein the internal cutting member and the external cutting member are furthermore designed to cause the friction to change during a fourth period of operation following the third period of operation, and the friction to be at a third level which is different from both the first level and the second level during a fifth period of operation following the fourth period of operation.

5. The electrical appliance according to claim 1, wherein the measuring means are adapted to perform a measurement of a parameter related to operation of the motor during idle running of the functional head.

6. The electrical appliance according to claim 1, wherein the processing means are adapted to determine a difference between a value of an actual measurement of the parameter and at least one reference value of the parameter, and to determine the information to be indicated to the user on the basis of the difference.

7. The electrical appliance according to claim 6, wherein the processing means are adapted to determine an end of an initial running-in period after the electrical appliance has been activated for the very first time, and to determine the at least one reference value of the parameter on the basis of a value of a measurement performed at the end of the running-in period.

8. The electrical appliance according to claim 1, wherein the internal cutting member and the external cutting member are designed to cause a change of at least one of:

types of material in a contact area between the internal cutting member and the external cutting member; and a size and/or a position of the contact area between the internal cutting member and the external cutting member at a predetermined degree of wear.

9. The electrical appliance according to claim 1, wherein at least an area of the pin for contacting the external cutting member in the worn-away condition of the at least one of the internal cutting member and the external cutting member includes material for causing a change of friction between the internal cutting member and the external cutting member when, during operation, the area of the pin comes into contact with the external cutting member.

10. The electrical appliance according to claim 1, wherein the internal cutting member includes at least one bump/rib which is arranged on a side of the internal cutting member facing the external cutting member, and wherein the bumps/ribs of the internal cutting member are arranged for contacting the external cutting member when a predetermined degree of wear of the at least one of the internal cutting member and the external cutting member is reached and hence when the internal cutting member and the external cutting member have moved closer towards one another.

11. The electrical appliance according to claim 1, wherein one of the internal cutting member and the external cutting member includes a layered structure of at least two different materials in an area for contacting the other one of the internal cutting member and the external cutting member.

12. The electrical appliance according to claim 1, wherein a surface of one of the internal cutting member and the external cutting member facing the other one of the internal cutting member and the external cutting member includes an elevated surface portion intended to wear away as a result of contact with the other one of the internal cutting member and the external cutting member.

13. The electrical appliance according to claim 1, wherein a surface of one of the internal cutting member and the external cutting member facing the other one of the internal cutting member and the external cutting member is provided with at least one projection, and wherein a surface of the other one of the internal cutting member and the external cutting member is provided with at least one recessed portion at a similar position.

14. An electrical appliance for performing a cutting action on hairs present on an area of skin, the electrical appliance comprising:

a functional head having at least one movably arranged internal cutting member for cutting off the hairs, and further having an external cutting member for contacting the area of skin, wherein the external cutting member is arranged in the functional head to cover and contact the internal cutting member, wherein the external cutting member is provided with hair-entry apertures for allowing the hairs to penetrate the external cutting member and thereby encounter the internal cutting member, and wherein the internal cutting member and the external cutting member are designed such that a friction between the internal cutting member and the external cutting member is related to a condition of wear of at least one of the internal cutting member and the external cutting member according to a predetermined relation between the friction and the wear;

a motor for driving the internal cutting member of the functional head;

measuring means for performing a measurement of a parameter related to the friction between the internal cutting member and the external cutting member;

processing means for processing the measured parameter and thereby determining an actual condition of wear of one of the internal cutting member and the external cutting member on the basis of the measured parameter; and indicating means for providing a user, of the electrical appliance with information relating to the actual condition of wear of the one of the internal cutting member and the external cutting member; wherein the external cutting member is rotatably arranged in the functional head, wherein the external cutting member includes a pin which is arranged on a side of the external cutting member facing the internal cutting member and which extends in a direction towards the internal cutting member, and wherein a length of the pin corresponds to a distance which, when present between the internal cutting member and the external cutting member, is predetermined to be a worn-away condition of at least one of the internal cutting member and the external cutting member.

15. The electrical appliance according to claim 14, wherein at least an area of the pin for contacting the internal cutting member in the worn-away condition of the at least one of the internal cutting member and the external cutting member includes material for causing a change of friction between the internal cutting member and the external cutting member when, during operation, the area of the pin comes into contact with the internal cutting member.

16. The electrical appliance according to claim 15 wherein the external cutting member includes at least one bump/rib which is arranged on a side of the external cutting member facing the internal cutting member, and wherein the bumps/ribs of the external cutting member are arranged for contacting the internal cutting member when a predetermined degree of wear of the at least one of the internal cutting member and the external cutting member is reached and hence when the internal cutting member and the external cutting member have moved closer towards one another.

17. An electrical appliance for performing a cutting action on hairs present on an area of skin, the electrical appliance comprising:

a head having at least one movably arranged internal cutting member for cutting the hairs, and further having an external cutting member for contacting the area of skin, wherein the external cutting member is arranged in the head to cover and contact the internal cutting member, wherein the external cutting member is provided with hair-entry apertures for allowing the hairs to enter the external cutting member and thereby encounter the internal cutting member, and wherein the internal cutting member and the external cutting member are designed such that a friction between the internal cutting member and the external cutting member is related to a condition of wear of at least one of the internal cutting member and the external cutting member according to a predetermined relation between the friction and the wear;

a motor for driving the internal cutting member of the head;

measuring means for performing a measurement of a parameter related to the friction between the internal cutting member and the external cutting member;

processing means for processing the measured parameter and thereby determining an actual condition of wear of one of the internal cutting member and the external cutting member on the basis of the measured parameter; and indicating means for providing a user of the electrical appliance with information relating to the actual condition of wear of the one of the internal cutting member and the external cutting member; wherein the internal cutting member is rotatably arranged in the head, wherein the internal cutting member includes a pin which is arranged on a side of the internal cutting member facing the external cutting member and which extends in a direction towards the external cutting member, and wherein a length of the pin corresponds to a distance which is determinative of the condition of wear of at least one of the internal cutting member and the external cutting member and the condition of wear indicates the required replacement of at least one of the cutting members.

18. The electrical appliance according to claim 17, wherein the internal cutting member and the external cutting member are designed such that the friction between them is at a first level during a first period of operation following initial use and an initial running-in period of the internal cutting member and the external cutting member, the friction changes during a second period of operation following the first period of operation, and the friction is at a second level, which is different from the first level, during a third period of operation following the second period of operation.

19. The electrical appliance according to claim 17, wherein the processing means are adapted to determine a difference between a value of an actual measurement of the parameter and at least one reference value of the parameter, and to determine the information to be indicated to the user on the basis of the difference.

20. The electrical appliance according to claim 17, wherein one of the internal cutting member and the external cutting member includes a layered structure of at least two different materials in an area for contacting the other one of the internal cutting member and the external cutting member.

* * * * *